United States Patent [19]

Schulte

[11] 4,066,175

[45] Jan. 3, 1978

[54] COKE-OVEN FILLING SYSTEM

[75] Inventor: Fritz Schulte, Meerbusch, Germany

[73] Assignee: Hartung, Kuhn & Co Maschinenfabrik GmbH, Dusseldorf, Germany

[21] Appl. No.: 663,985

[22] Filed: Mar. 4, 1976

[30] Foreign Application Priority Data

Mar. 7, 1975 Germany ..... 2510097

[51] Int. Cl.[2] ..... F27D 3/08

[52] U.S. Cl. ..... 214/35 R; 193/30; 202/262; 214/18 PH

[58] Field of Search ..... 214/18 PH, 35 R; 193/30; 202/262, 263; 141/231, 232, 233, 272

[56] References Cited

U.S. PATENT DOCUMENTS

| | | | |
|---|---|---|---|
| 539,295 | 5/1895 | Pierson | 193/30 |
| 3,576,263 | 4/1971 | Abendroth | 193/30 X |
| 3,764,026 | 10/1973 | Olah | 214/18 PH X |
| 3,958,700 | 5/1976 | Foy et al. | 214/18 PH X |

*Primary Examiner*—Albert J. Makay
*Attorney, Agent, or Firm*—Michael J. Striker

[57] ABSTRACT

A filling system operating with an apparatus for loading coal into the charging hole of a coke oven has an upper feed tube, an intermediate feed tube, and a lower tube. The upper tube is connected to the apparatus and is adapted to receive coal from it. The intermediate upright tube is vertically telescopable on the upper tube and has a lower end, with a bellows-type cuff interconnecting the upper and intermediate tubes to prevent leakage from therebetween. The lower tube is pivoted and suspended on the intermediate tube and is alignable with this intermediate tube so that its lower end can sealingly engage over a charging hole in a coking oven and its upper end can sealingly engage with the lower end of the intermediate tube. The intermediate tube can be limitedly vertically displaced and the lower tube can be pivoted out from beneath the intermediate tube so that the filling system has clearance and can pass over the structure on top of the coking oven.

9 Claims, 3 Drawing Figures

201
201a
215
214
202
206
221
203
204
202a
226a
B
223a
227
205
226
230
238
237
233
241a
232
224
236
223a
228a
224a
228a
229
231
241a
231
230
234
X
235
229
D
d
239

COKE-OVEN FILLING SYSTEM

BACKGROUND OF THE INVENTION

The present invention relates to a filling system for loading coal into the charging hole of a coke oven. More particularly this invention concerns a filling tube arrangement for conducting preheated coal from a larry car into the charging hole of a coke oven.

A larry car is provided with a downwardly extending feed tube. Preheated coal is fed to the top of this feed tube either through an auger or a turntable arrangement so that it can be conducted by the feed tube into the charging hole of an oven of a coking battery. Typically a telescoping lower tube is provided slidable on the feed tube and having a lower end which can be fitted tightly against the charging hole. Thus the poisonous and often explosive hot gases inside the coking oven cannot escape during the filling operation.

A seal, normally a gland or other tight rubbing-type seal, is provided between the lower telescoping tube and the upper tube in order to allow this lower tube to be lifted during displacement of the filling wagon from one oven to the next of the battery. Since it is necessary to raise the lower telescoping part of the feed tube through a considerable distance in order to clear the various structural parts on the top of the coking battery, this seal is subjected to considerable wear. Furthermore the abrasive dust and corrosive hot gases within the feeding arrangement further lead to premature wearing-out of this seal so that it must be replaced frequently.

SUMMARY OF THE INVENTION

It is therefore an object of the present invention to provide an improved filling system for loading coal into the charging hole of a coke oven.

Another object of this invention is the provision of such a filling system which can be shortened considerably, but wherein the above-described sealing problems are obviated.

These objects are attained according to the present invention in a filling system comprising an upper feed tube connected to the coal-loading apparatus and adapted to receive coal therefrom, an intermediate upright tube vertically telescopable on the feed tube and having a lower end, a seal connected between the intermediate tube and the feed tube and permitting relative telescoping therebetween, and a lower tube suspended from the intermediate tube and alignable with this intermediate tube. This lower tube has a lower end sealingly engageable over the charging hole and an upper end sealingly engageable with the lower end of the intermediate tube. Means is provided for displacing the lower tube out of alignment with the intermediate tube.

In accordance with the present invention the seal is a bellows-type cuff having an upper end tightly connected to the upper feed tube and a lower end tightly connected to the intermediate tube that telescopes on the feed tube. It is possible to use such a seal in accordance with the present invention because the amount of telescoping of the upper and intermediate tubes relative to one another is relatively limited, since the entire filling system is shortened considerably by displacement of the lower tube out from beneath the intermediate tube.

In accordance with another feature of this invention the intermediate tube is provided with a pair of aligned pivots defining a horizontal pivot axis. A support plate lying in a generally vertical plane is suspended and can swing on each of these pivots so that these plates flank the lower tube. A non-rigid link, such as a metal cable, a chain, or a chain link, is connected between each of these plates and the lower tube so as to suspend the lower tube but allow limited vertical displacement of the lower tube relative to the intermediate tube. Means is provided for pivoting these two plates on their pivot axis so as to swing the lower tube out from beneath the intermediate tube and allow the entire filling system to be displaced across the top of a coke battery leaving clearance for the structure on the top of this battery.

In accordance with yet another feature of this invention the lower tube is provided with at least two lateral projections extending in directions parallel to the pivot axis. The plates have arms which are engageable against these projections so that when the plates are pivoted the lower tube, even though it is supported by non-rigid links, is also pivoted up by engagement of the arms against these projections.

According to further features of this invention the intermediate tube is limitedly vertically displaceable by a lever linkage that is connected to another lifting device for tipping up the plates carrying the lower tube. The lower tupe may be tipped through an angle of at least 30° relative from its normally vertical position. The upper tube is vertically displaced through a distance equal to a very small fraction, no greater than one-fifth, of the length of the lower tube and when pivoted up the lowest part of the lower tube is raised by a distance equal to at least twice the distance through which the intermediate and lower tubes are raised by the first lifting device connected only to the intermediate tube.

According to yet another feature of this invention the lower end of the intermediate tube and the upper end of the inner tube are formed as complementary part-spherical surfaces. Thus even when the axes of these two tubes are not perfectly aligned it is possible for them to bear on one another in tight sealing contact.

With the system according to the present invention the extent of vertical displaceability of the intermediate tube relative to the filling tube is greatly reduced so that a very tight bellows-type seal may be employed between the two which has an extremely long service life. Furthermore the pivotability of the lower tube relative to the intermediate tube allows the arrangement to be shortened considerably so that even though this intermediate tube can only be displaced a short distance it is possible to raise the actual lower end of the filling system in order to move it around on top of the coking battery. When the intermediate tube is dropped down on top of the lower tube whose lower end is fitted over the charging hole of the particular coking oven being filled an extremely tight seal is created at both ends of the lower tube and the filling operation can take place with virtually no escape of dust or gases into the surrounding atmosphere.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
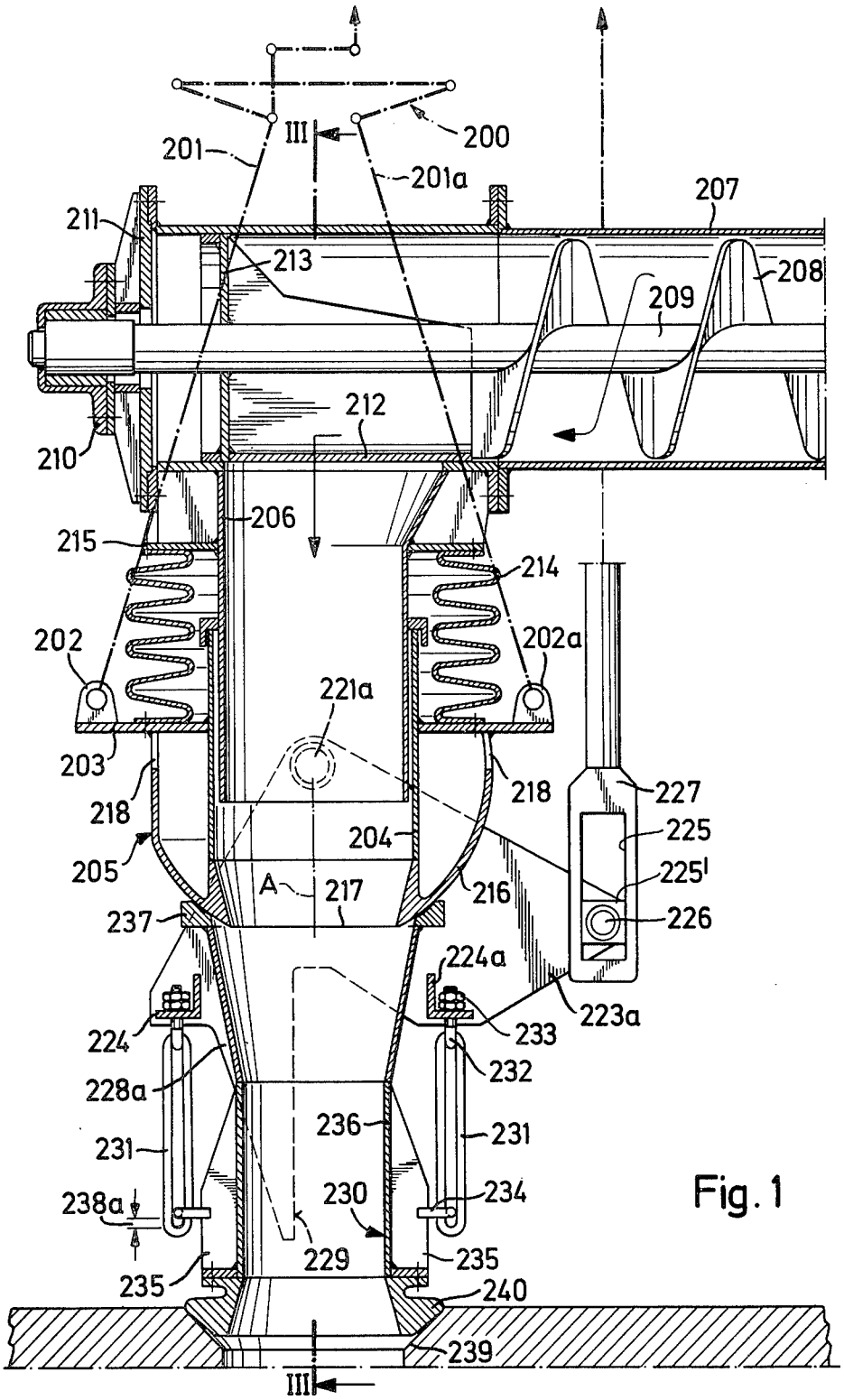
FIG. 1 is a vertical section through a filling system according to the present invention in the lowered filling position.

As shown in FIG. 1 a lever arrangement 200 has a pair of downwardly extending flexible support cables 201 and 201*a* connected to respective eyes 202 and 202*a* of a flange 203. This flange extends horizontally from a vertical and cylindrical intermediate tube 204 constituting the inner member of an intermediate telescoping section 205. Another vertical cylindrical filling tube 206 is telescoped within the tube 205 and connected at its upper end to a horizontally extending feed tube 207 in which an auger 208 is carried on a shaft 209 journalled in a bearing 210 at the end cap 211 of the tube 207. Coal is supplied to the right-hand end of the feed tube 207 and the auger is rotated by a motor in a direction tending to advance this coal toward the left. At its left-hand end the auger carries a part-cylindrical plate 212 that is welded to a circular disc 215 carried on the shaft 209. The part-cylindrical plate 212 extends to an arc length of less than 180° and can be positioned to block the downwardly open outlet in the tube 207.

Bolted to the top of the flange 203 and to the bottom of a plate 215 carried on the filling tube 206 is a spring-steel bellows-type cuff that allows limited vertical displacement of the tube 204 relative to the tube 206. It is therefore possible for the tube 204 to loosely surround the tube 206 but leakage between these tubes is prevented by the seal 214.

The tube 204 has a downwardly tapering frustoconical outlet opening 217 and is provided with a skirt 216 forming a part-cylindrical surface centered on the vertical axis A of the tubes 204 and 206. The part-spherical skirt 216 is formed with throughgoing holes 218 underneath the flange 203.

Figure 3:
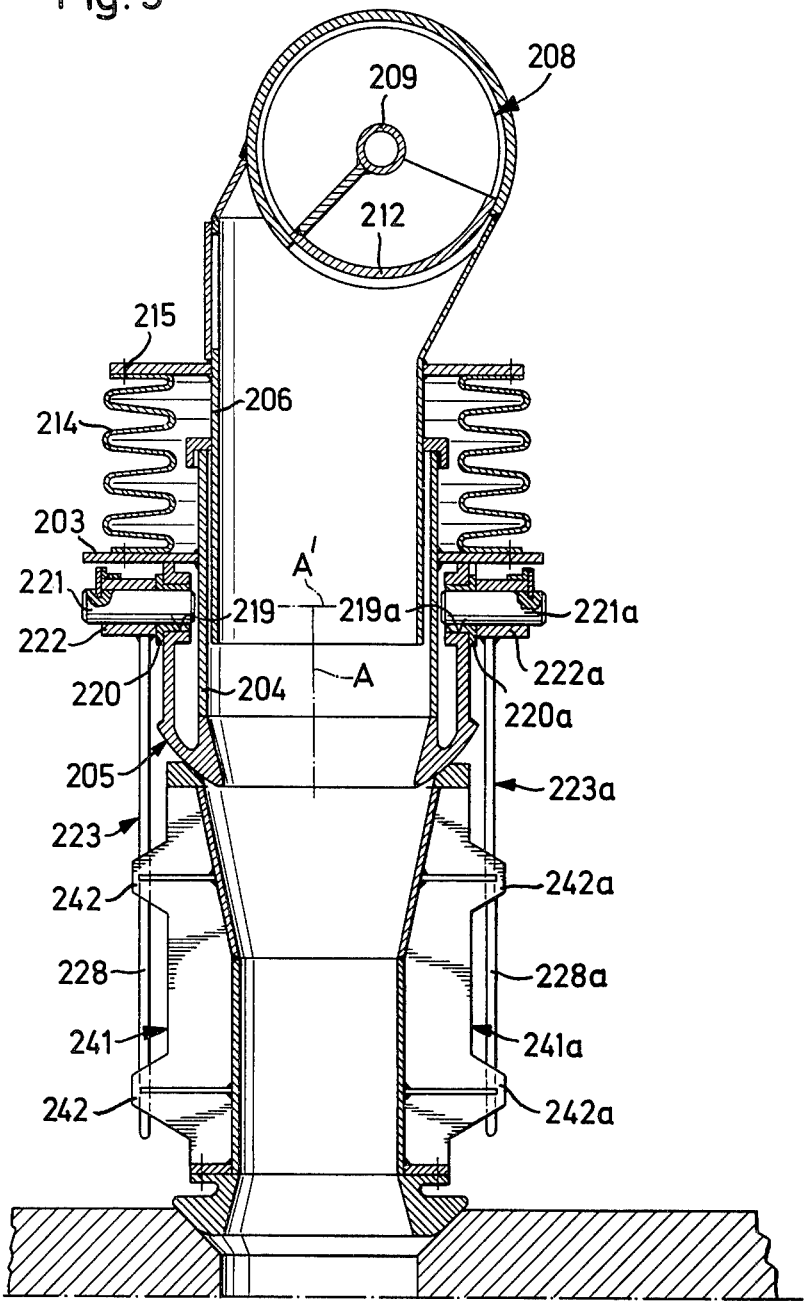
FIG. 3 is a section taken along line III—III of FIG. 1.

As also shown in FIG. 3 the skirt 216 carries below the flange 203 diametrically opposite holes 219 and 219*a* in which are received journals 220 and 220*a* mounting pivot pins 221 and 221*a* that define an axis A′ perpendicular to and intersecting the axis A. Further journals 222 and 222*a* carried on respective vertical plates 223 and 223*a* surround the pivot pins 221 and 221*a* and are keyed thereto so as to be axially non-displaceable relative to these pins 221 and 221*a*.

Rigid and parallel angle irons 224 and 224*a* extending parallel to the axis A′ extend between the plates 223 and 223*a* and flank a lower tube 236.

These plates 223 and 223*a* are bridged by a pin 226 parallel to the axis A′ and offset therefrom by a distance equal to at least twice the diameter of the tube 206. A lever rod or piston rod 227 is formed with a throughgoing rectangular-section hole 225 in which a block 225′ carried on the pivot 226 is limitedly slidable. This lever 227 is linked to the levers 200 so that the plates 223 and 223*a* can be pivoted from the solid-line position of FIG. 2 to the dot-dash line position in that Figure in the direction of arrow X after lifting of the intermediate tube 204 from the position of FIG. 1 to the position of FIG. 2.

Suspended from each of a pair of eyes 232 secured via double lock nuts 233 in the cross members 224 is a long chain link 231 whose lower end is hooked through an eye 234 carried on one of four ribs 235 on the lower tube 236 forming part of the lower movable assembly 230. In addition each of the plates 223 and 223*a* is flung with a downwardly extending arm 228 and 228*a* having an edge 229 (see FIG. 1) engageable with projections 242 and 242*a* on a vertical rib 241 and 241*a* on the lower tube 236. These projections 242 and 242*a* on each rib 241 and 241*a* are vertically spaced apart and define a plane lying on the axis A as seen in FIGS. 1 and 3. Thus pivoting of the plates 223 and 223*a* up will cause the edges 229 to engage against these projections 242 and 242*a* and pivot the lower tube assembly 230 up into the dot-dash line position of FIG. 2.

Figure 2:
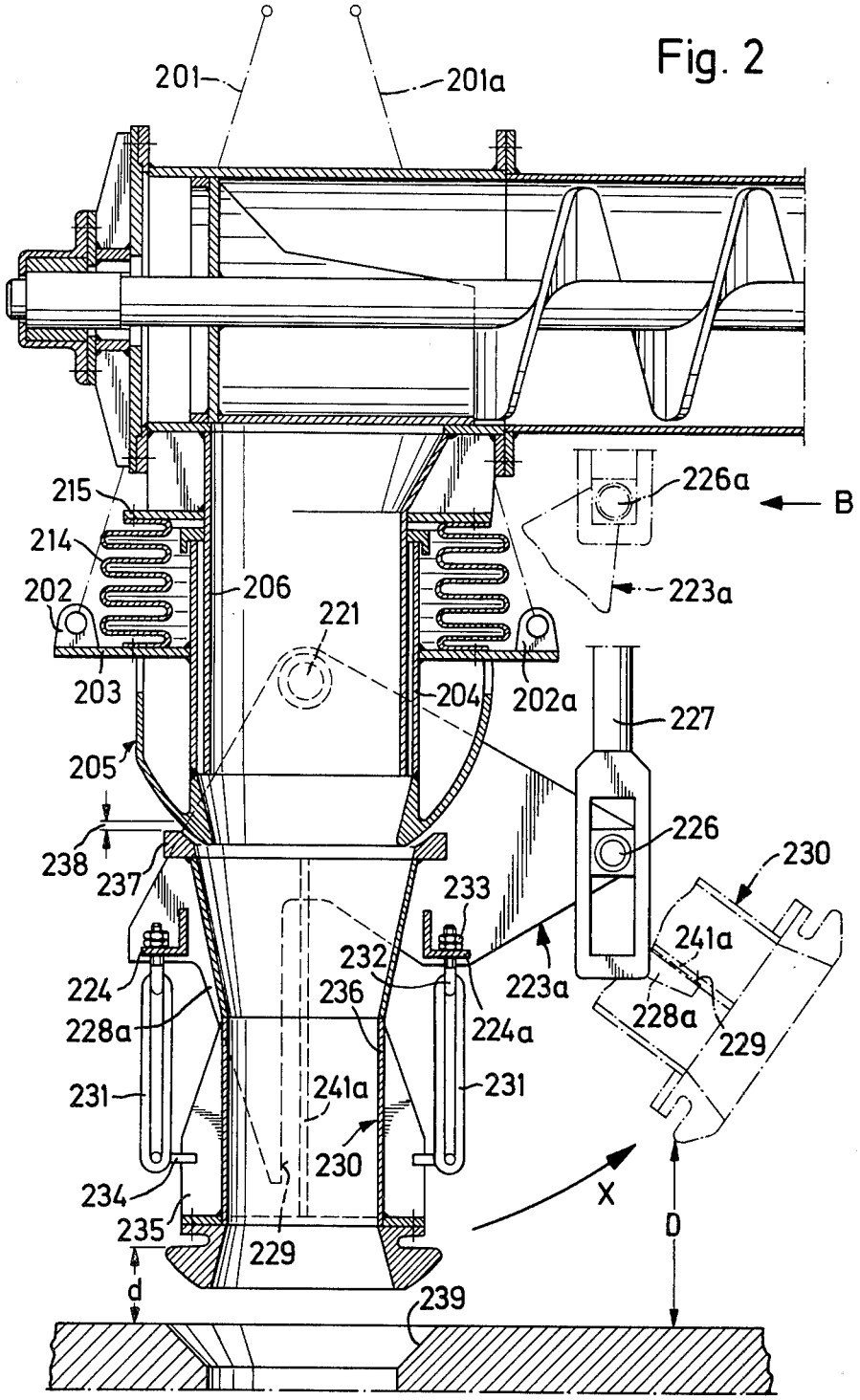
FIG. 2 is a view similar to FIG. 1 illustrating in solid lines the intermediate raised position of the filling system and in dot-dash lines the fully raised position of the filling system.

The links 231 are of a length such that when the intermediate tube 204 is lifted as shown in FIG. 2 the lower tube assembly 230 is spaced from the upper tube assembly 205 by a distance 238 equal to approximately one-twentieth of the overall length of the lower tube 236. When the intermediate tube 204 is lowered all the way down, however, so as to press against the spherical upper seat 237 on the lower tube 236 and to force the lower end 240 of the lower tube into the upwardly flared charging hole 239 of a coking oven a space 238*a* is formed between the lower edge of the slot in each link 231 and the respective eye 234. This spacing 238*a* is identical to the spacing 238.

Since the mating faces of the upper end 237 of the tube 236 and the lower end 216 of the tube 204 are part-spherical and of the same radius of curvature these two parts need not be exactly aligned in order to insure a good seal. They will automatically center and prevent gas and dust from leaking at this joint. When the arrangement is lifted as shown in dot-dash lines in FIG. 2 the lowermost part of the lower edge 240 of the tube 236 is spaced from the top of the coking oven by a distance D equal to at least twice the distance *d* through which the lever arrangement 200 lifts the intermediate tube 204. The chain links 231 could be replaced by chains or cables, these links 231 being non-rigid in that they allow limited vertical and horizontal displaceability of the lower tube 236 relative to the middle tube 204 to insure that the above-described self-centering takes place, and that the lower tube will be able to shift up toward the intermediate tube as the intermediate tube is lowered and the lower tube comes to rest on the mouth 239 of the coking oven.

It will be understood that each of the elements described above, or two or more together, may also find a useful application in other types of systems differing from the types described above.

While the invention has been illustrated and described as embodied in a coke-oven filling system, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In combination with apparatus for loading coal into the charging hole of a coke oven, a filling system comprising an upper feed tube connected to said apparatus and adapted to receive coal therefrom; an intermediate upright tube vertically telescopable on said feed tube and having a lower end and pivots defining a horizontal axis; a seal connected between said intermediate tube and said feed tube and permitting relative telescoping therebetween; a lower tube suspended from said pivots of said intermediate tube and alignable with said intermediate tube and having a lower end sealingly engageable over said charging hole and an upper end sealingly engageable with said lower end of said intermediate tube; and means for displacing said lower tube out of alignment with said intermediate tube.

2. The filling system defined in claim 1, wherein said seal is a bellows-type cuff.

3. The filling system defined in claim 1, wherein said upper end of said lower tube and said lower end of said intermediate tube are of complementary part-spherical shape.

4. The filling system defined in claim 1, wherein said intermediate tube has a non-rigid link connected to each pivot and having a lower end connected to said lower tube, whereby said lower tube can move limitedly vertically relative to said intermediate tube.

5. The filling system defined in claim 4, further comprising means for raising and lowering said intermediate tube relative to said upper tube.

6. The filling system defined in claim 4, wherein said lower tube has a pair of oppositely projecting lateral extensions generally parallel to said pivot axis, said means for displacing including a pair of arms pivotal on said pivots and each engageable with a respective one of said extensions.

7. The filling system defined in claim 6, wherein said means for displacing includes a pair of upright plates flanking said lower tube and each pivotal on a respective one of said pivots, each of said plates being formed with a one of said arms and each of said links being connected to a respective one of said plates.

8. The filling system defined in claim 7, wherein a pair of such links spaced apart perpendicularly to said axis each have upper ends secured to the respective plate and lower ends secured to said lower tube.

9. The filling system defined in claim 4, wherein said means for displacing includes a lever linkage and said system further comprises means including another lever linkage coupled to the first-mentioned lever linkage for raising said intermediate tube relative to said feed tube.

* * * * *